US010767594B2

(12) United States Patent
Weber et al.

(10) Patent No.: US 10,767,594 B2
(45) Date of Patent: Sep. 8, 2020

(54) METHODS AND SYSTEMS FOR ENGINE BLOCK THERMAL CONDUCTIVITY

(71) Applicant: Ford Global Technologies, LLC, Dearborn, MI (US)

(72) Inventors: Carsten Weber, Leverkusen (DE); Paul Turner, Chelmsford (GB); Urban Morawitz, Cologne (DE); Clemens Maria Verpoort, Monheim am Rhein (DE)

(73) Assignee: Ford Global Technologies, LLC, Dearborn, MI (US)

( * ) Notice: Subject to any disclaimer, the term of this patent is extended or adjusted under 35 U.S.C. 154(b) by 24 days.

(21) Appl. No.: 16/279,261

(22) Filed: Feb. 19, 2019

(65) Prior Publication Data

US 2019/0257263 A1 Aug. 22, 2019

(30) Foreign Application Priority Data

Feb. 20, 2018 (DE) ..... 10 2018 202 540

(51) Int. Cl.
*F02F 1/00* (2006.01)
*C23C 28/02* (2006.01)
(Continued)

(52) U.S. Cl.
CPC ..... *F02F 1/004* (2013.01); *C23C 4/06* (2013.01); *C23C 26/00* (2013.01); *C23C 28/021* (2013.01); *F02F 1/08* (2013.01)

(58) Field of Classification Search
CPC .... F02F 1/004; F02F 1/08; C23C 4/06; C23C 26/00; C23C 28/021
See application file for complete search history.

(56) References Cited

U.S. PATENT DOCUMENTS 6,044,820 A * 4/2000 Domanchuk ..... C23C 4/185 123/193.2
7,685,987 B2 * 3/2010 Miyamoto ..... B22D 19/0009 123/193.1
(Continued)

FOREIGN PATENT DOCUMENTS

DE 102006010190 A1 9/2007
DE 102017103715 A1 9/2017
(Continued)

OTHER PUBLICATIONS

Ritter, H., "BMW 320si: limited special edition with 173 hp," Autokiste Website, Available Online at http://www.autokiste.de/psg/archiv/a.htm?id=4800, Nov. 22, 2005, 2 pages. (Submitted With Machine Translation).
(Continued)

*Primary Examiner* — Jacob M Amick
(74) *Attorney, Agent, or Firm* — Geoffrey Brumbaugh; McCoy Russell LLP

(57) ABSTRACT

Methods and systems are provided for coatings of a portion of an engine block shaping a combustion chamber. In one example, the engine block includes a first coating with a thermal conductivity higher than a conductivity of the engine block arranged in an upper region of the combustion chamber and a second coating with a thermal conductivity lower than the conductivity of the engine block arranged in a lower region of the combustion chamber, and where the second coating touches the first coating.

20 Claims, 10 Drawing Sheets

(51) Int. Cl.

| | |
|---|---|
| ***C23C 26/00*** | (2006.01) |
| ***C23C 4/06*** | (2016.01) |
| ***F02F 1/08*** | (2006.01) |

(56) References Cited

U.S. PATENT DOCUMENTS

| | | | | |
|---|---|---|---|---|
| 2013/0340700 | A1* | 12/2013 | Donahue | F16J 10/04 123/193.2 |
| 2019/0085786 | A1* | 3/2019 | Petrus | C23C 4/08 |

FOREIGN PATENT DOCUMENTS

| | | | |
|---|---|---|---|
| DE | 102016205754 | A1 | 10/2017 |
| EP | 3228852 | A1 | 10/2017 |
| JP | 4812883 | B2 | 11/2011 |
| JP | 2016205215 | A | 12/2016 |
| WO | 2016202511 | A1 | 12/2016 |

OTHER PUBLICATIONS

Bobzin, K. et al., "Thermal spraying of cylinder bores with the Plasma Transferred Wire Arc process," Surface and Coatings Technology, vol. 202, No. 18, Jun. 15, 2008, Available Online Apr. 8, 2008, 6 pages.

"Auto Motor und Sport," Auto Motor und Sport Website, Available Online at http://www.auto-motor-und-sport.de/news/bmw-320si-rennbenzin-im-blut-651538.html, Available as Early as Jan. 1, 2009, 10 pages. (Submitted With Machine Translation).

"MotorsportMarkt.de," Motorsport Website, Available Online at http://www.motorsportmarkt.de/show/rennfahrzeuge/rennfahrzeuge/bmw-320si-wtcc-andy-priaulx.html, Available as Early as Jun. 26, 2007, 6 pages. (Submitted With Machine Translation).

* cited by examiner

METHODS AND SYSTEMS FOR ENGINE BLOCK THERMAL CONDUCTIVITY

CROSS REFERENCE TO RELATED APPLICATION

The present application claims priority to German Patent Application No. 102018202540.1, filed Feb. 20, 2018. The entire contents of the above-listed application are hereby incorporated by reference for all purposes.

FIELD

The present description relates generally to enhancing thermal conductivity of an engine block in the vicinity of a combustion chamber piston.

BACKGROUND/SUMMARY

Traditionally, crankcases or engine blocks may be manufactured for internal combustion engines from aluminum or aluminum alloys in a high pressure die casting (HPDC) process. The HPDC process may provide weight reduction and heat transfer enhancements relative to cast iron materials.

For meeting the tribological requirements, it is also known to use cylinder liners consisting of gray cast iron material with a wall thickness of typically between 2 and 4 mm in engine blocks consisting of aluminum or aluminum alloys. In this case, some of the advantages with regard to the dissipation of the waste heat are lost since the thermal conductivity of gray cast iron material with approximately $$40-50\,\frac{W}{m\cdot K}$$

is only a fraction of the thermal conductivity of the aluminum material or approximately $$140\,\frac{W}{m\cdot K}.$$

Therefore, cylinder liners consisting of high thermal conductive aluminum are also used. From the article of K. Bobzin, F. Ernst, K. Richardt, T. Schlaefer, C. Verpoort, and G. Flores: "Thermal spraying of cylinder bores with the Plasma Transferred Wire Arc process" in Surface and Coatings Technology, Vol. 202, Edition 18, Jun. 15, 2008, p. 4438-4443, it is known that engine blocks of automobiles consisting of sub-eutectic AlSi alloys are customarily equipped with cast iron sleeves in order to obtain cylinder bore surfaces which satisfy the tribological requirements. Thermally sprayed cylinder bore surfaces are described therein as a promising alternative to gray cast iron liners. Atmospheric plasma sprayed (APS) cylinder bore surfaces consisting of low-alloyed C-steel had already proved their capability to reduce friction losses in engines. Additional potential for reducing friction losses is unprecedented and is attributed to high-alloyed surface materials on an iron base. The article describes the development of such materials and their use via the thermal plasma transferred wire arc coating (PTWA) process on inner walls. The feed materials lead to partially amorphous coatings with embedded boridic, nanoscale precipitations if they are processed by thermal spraying. The coatings were deposited on the inner walls of test liners consisting of aluminum EN AW 6060 and on the cylinder bore walls of a 4-cylinder inline engine. Before coating, all the surfaces to be coated were pretreated by a new type of fine boring process in order to create a surface topography which enables the adherence of the coatings. The microstructures of the coatings were analyzed via optical microscopy, durometry and transmission electron microscopy, and the oil retention capacities of the honed surfaces were determined.

In other alternative approaches, the use of cylinder liners is dispensed with, and the cylinder walls of the engine block are coated in order to achieve for example the desired resistance to friction and wear. The coatings are designed in respect to material choice and arrangement depending on the desired function.

For producing the coatings, thermal processes are used, wherein particular attention is to be paid to a trouble-free application of the coating on the cylinder wall which is to be coated. In previous examples, specific processes and devices are proposed for this.

For example, WO 2016/202511 A1 describes a thermal spraying method and a device for coating the inner surface of a cylinder of an internal combustion engine or piston engine, wherein the method features applying a thermal spray layer to the inner surface of the cylinder and optical detection of the surrounding of the spray jet, specifically of a space outside the spray jet, via an optical sensing device. In this case, an error in the coating process is assumed if particles of the spray material, which is fed to the spray burner, are detected by the optical sensing device in the monitored region outside the spray jet. For example, the thermal spray process is formed by known plasma transferred wire arc spraying (PTWA) processes or rotating single wire (RSW) processes.

Proposed in DE 10 2017 103 715 A1 is a coating of a cylinder liner or cylinder wall with a functional layer which on account of its variable porosity ensures different lubricating requirements in different regions of the cylinder bore are fulfilled.

The engine block, which for example can be produced from cast iron, aluminum, magnesium or alloys thereof, can have a body which has at least one cylindrical engine bore wall with a longitudinal axis, and has a variable coating, extending along the longitudinal axis, which has a coating thickness. The coating can have a middle region and a first and a second end region, and a plurality of pores can be distributed in the coating thickness. The middle region can have a different average porosity than one or both of the end regions. The method can involve thermal spraying of a coating with a first porosity in a middle longitudinal region of the bore and spraying of a coating with a second porosity in one or more end regions of the bore. The coating can be all coatings which provide sufficient mechanical strength, rigidity, density, wear properties, friction, fatigue strength and/or thermal conductivity for a cylinder bore, and can especially also be formed by a coating with iron, steel, other metals or non-metals, as a ceramic coating, polymer coating or as an amorphous carbon coating. The first porosity can be greater than the second porosity, and the first porosity and the second porosity can be formed during the spraying step. One or both of the end regions can have an average porosity of between 0.1% and 3%. The middle region can have an average porosity of at least 5%. The pores can act as recesses for lubricant in this case, as a result of which lubrication under rough operating conditions is provided and the lubricant film thickness is improved.

The application of coatings on cylinder walls for influencing heat flows during operation of the internal combustion engine is also known.

For example, EP 3 228 852 A1 proposes an internal combustion engine with a combustion chamber, which is enclosed by at least one inner wall of a cylinder bore, a cylinder head, a valve and a piston, and a coating layer which is arranged on at least one part of the inner wall of the combustion chamber via a flame spraying process, wherein the thermal conductivity of the coating layer at room temperature is lower than the thermal conductivity of the cylinder block, the cylinder head, the valve and the piston. In this case, the thermal conductivity of the coating layer, which for example can contain a quasi-crystalline metal alloy, especially an Al—Cu—Fe-based alloy, or a metallic glass, is reversibly increased with a rise of the temperature of the coating layer, and the thermal capacity per unit area of the coating layer is greater than $$0\frac{kJ}{m^2 \cdot K}$$

and less than, or equal to, $$4.2\frac{kJ}{m^2 \cdot K}.$$

As a result, the effect of minimizing cooling losses of the combustion chamber and consequently the fuel consumption is to be achieved and at the same time knocking of the internal combustion engine can be mitigated.

Described in JP 4812883 B2 is a cylinder liner for insert casting and for use in a cylinder block consisting of an aluminum alloy, wherein a layer with a thermal conductivity which is lower than a thermal conductivity of at least one out of the cylinder block and the cylinder liner is formed by an intermediate section of the cylinder liner in the axial direction toward a lower end. The layer can for example consist of a sprayed-on layer of ceramic material; in this case aluminum oxide is used as the ceramic material. The layer is formed via thermal spraying, for example, via plasma spraying or high-velocity oxygen fuel spraying (HVOF). As a result of the low thermal conductive layer, there should be the possibility of preventing a temperature at the lower end of the cylinder liner dropping undesirably low during operation of the cylinder block, which can lead to increased viscosity of the lubricating oil and therefore to higher fuel consumption.

Proposed, moreover, in JP 2016205215 A is a method for producing a cylinder block which has a higher thermal conductivity coefficient on an outer circumferential wall of a cylinder bore on an upper part than that of a lower part of the cylinder bore in its axial direction without any complex steps having to be applied for establishing cylinder liners with a different thermal conductivity coefficient in an axial direction on a casting mold for the cylinder block. In the method, a cylinder bore is designed with a standard inside diameter by forming a cylinder-block main body, for example from an aluminum alloy, in a way in which an inside diameter is created on a lower part of a bore hole for forming the cylinder bore which is larger than an inner diameter of an upper part of the bore hole. After that, material with low thermally conducting material, for example an iron-based material, with a lower thermal conductivity coefficient than that of the material forming the main body of the cylinder block, is flame-sprayed against a first circumferential wall surface and a second circumferential wall surface of the circumferential surface, which defines the bore hole, of the cylinder block main body in order to form a sprayed layer, wherein the sprayed layer on the first circumferential wall is thicker than the sprayed layer on the second circumferential wall.

Furthermore, a cylinder liner, for example consisting of cast iron and for insert casting, which is used in a cylinder block consisting of an aluminum alloy, is known in U.S. Pat. No. 7,685,987 B2. The cylinder liner has an outer circumferential surface and upper, middle and lower sections with regard to an axial direction of the cylinder liner. A high thermally conducting layer, for example consisting of an aluminum-silicon alloy, is formed in a section of the outer circumferential surface which corresponds to the upper section, and a low thermally conducting layer is formed in a section of the outer circumferential surface which corresponds to the lower section. A sprayed-on layer mainly consisting of a ceramic material such as aluminum oxide and zirconium oxide can be used as material of the low thermally conducting layer. Alternatively, the low thermally conductive layer can be formed from a sprayed layer of a material on an iron base which contains oxides and a number of pores. The high thermally conductive layer and the low thermally conductive layer are laminated in a section of the outer circumferential surface which corresponds to the middle section, as a result of which a laminated layer section is formed. As a consequence of this, the temperature difference along the axial direction of the cylinder is reduced, as a result of which the fuel consumption can be reduced.

In light of the illustrated previous example, the field of coating piston paths of internal combustion engines, which are arranged either on the inner wall of a cast cylinder liner in the engine block or on the inner wall of a cylinder bore of an engine block, especially of internal combustion engines having engine blocks consisting of aluminum or at least an aluminum alloy, still provides room for improvements with regard to a thermal design and enhancement of waste heat flow.

In one example, the issues described above may be addressed by an engine block comprising a first coating arranged on interior surfaces of a cylinder near a top-dead center position of a piston and a second coating arranged on the interior surfaces near a bottom-dead center position of the piston, the first coating comprising a hypereutectic aluminum-silicon alloy and the second coating comprising an iron-based alloy with a thermal conductivity lower than the first coating and the interior surfaces. In this way, thermal conductivity in the combustion chamber may be enhanced to promote heat dissipation or heat retention as desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-7 are shown approximately to scale, although other relative dimensions may be used, if desired.

DETAILED DESCRIPTION

Figure 1:
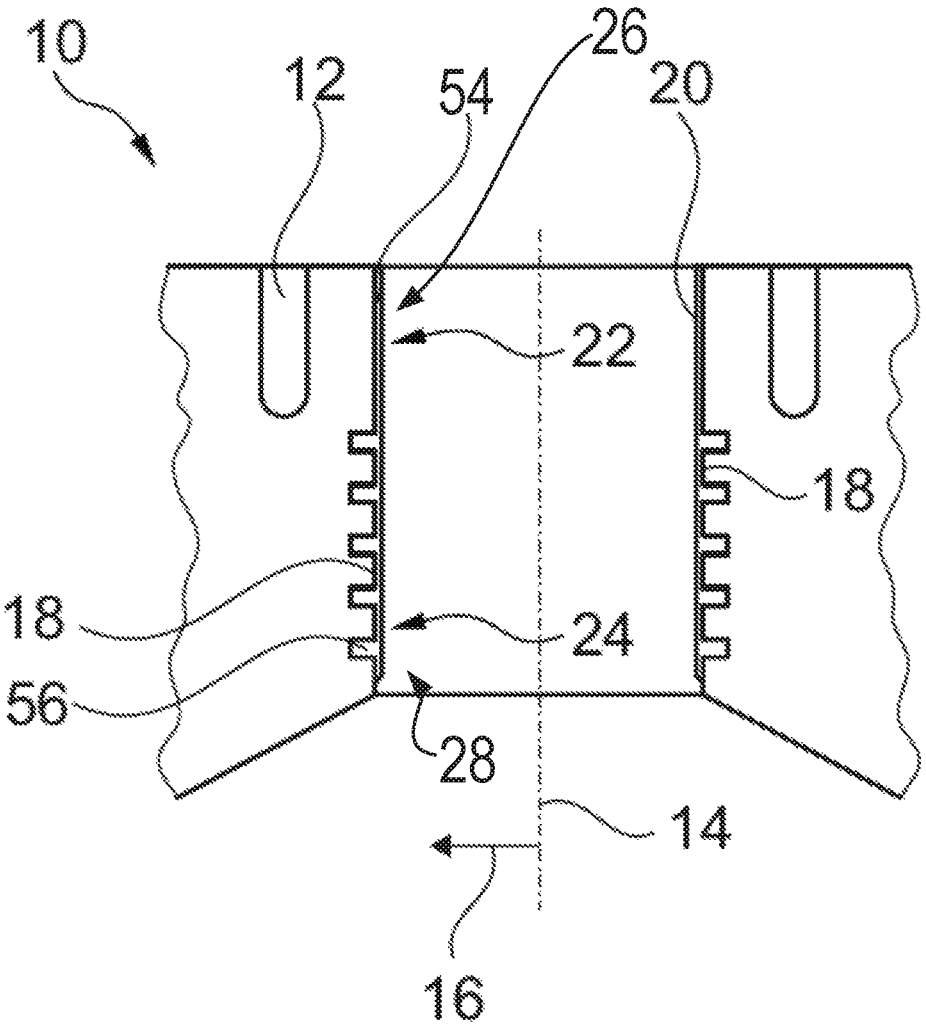
FIG. 1 illustrates a schematic view of a part of an engine block in a sectioned view.
Figure 2:
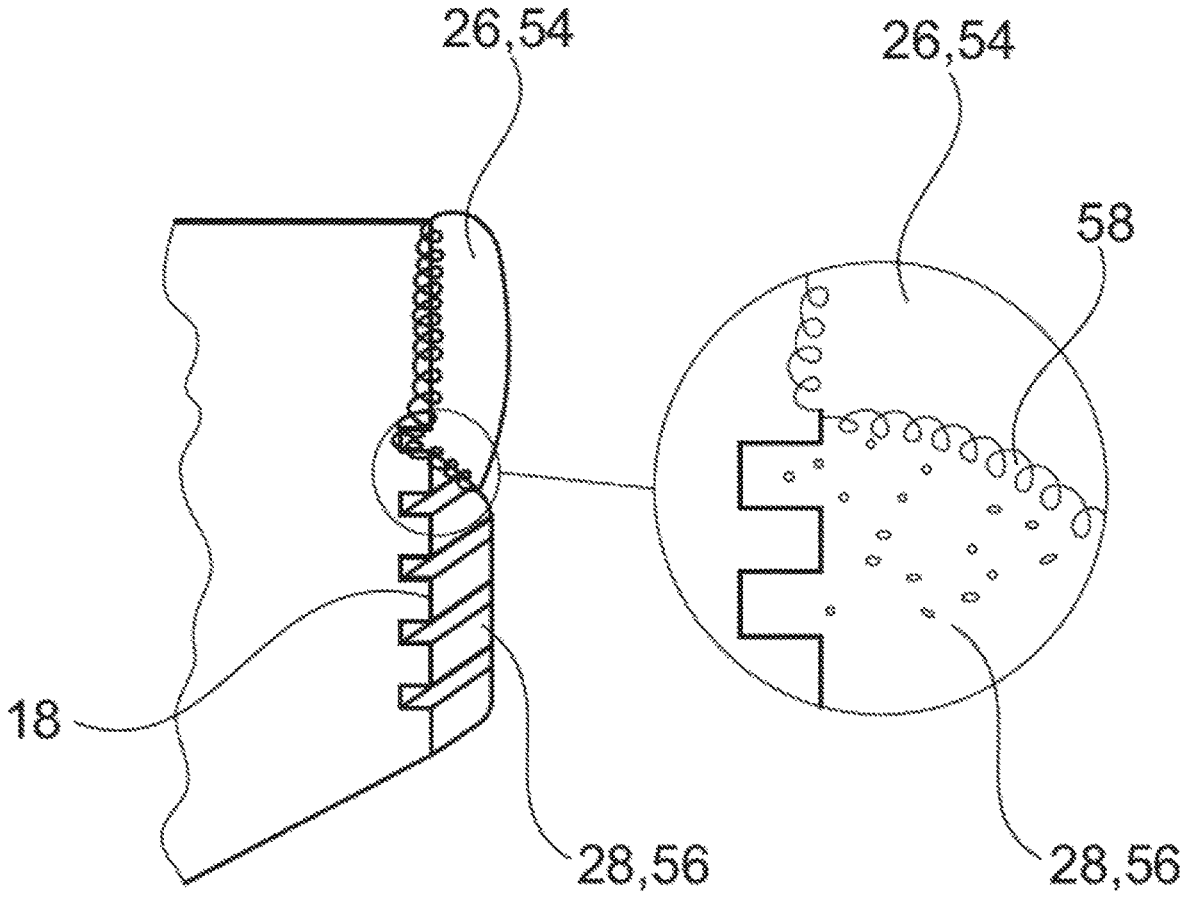
FIG. 2 illustrates a detail of the engine block in a schematic sectioned side view.
Figure 3:
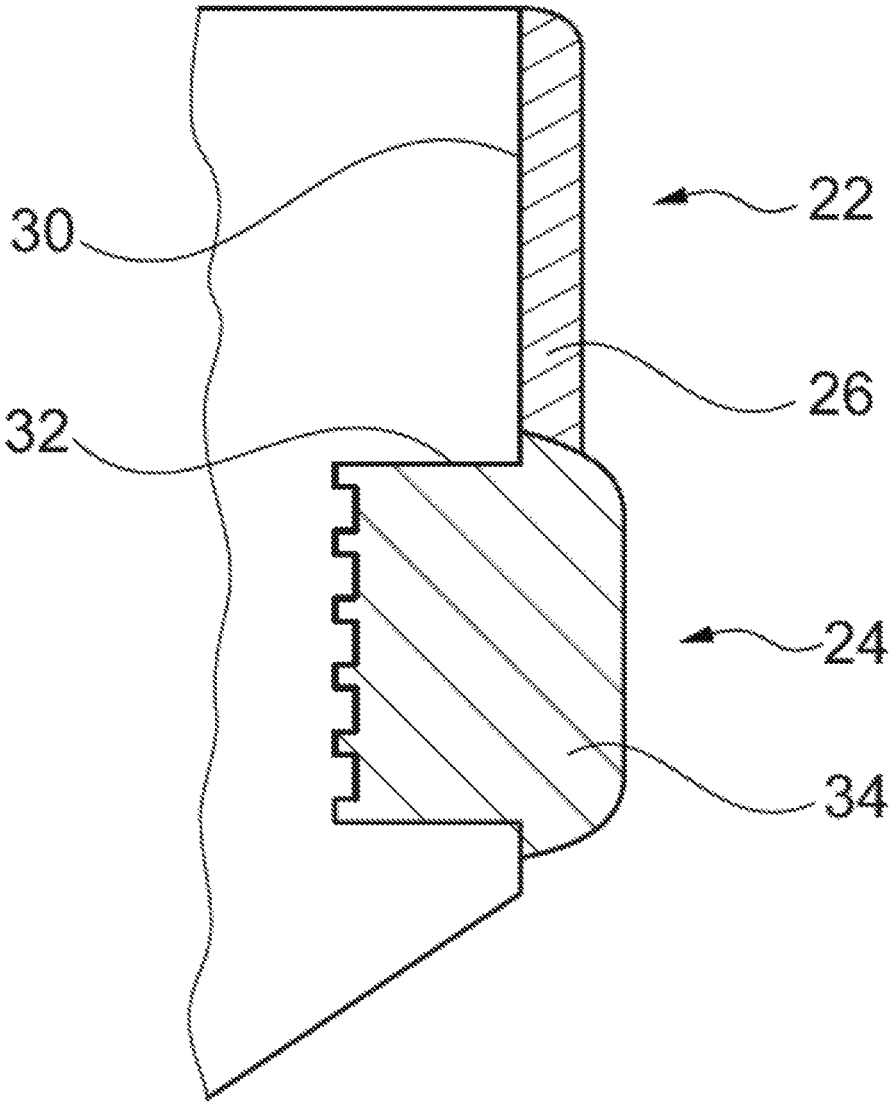
FIG. 3 illustrates a schematic view of a detail of an alternative embodiment of an engine block.
Figure 4:
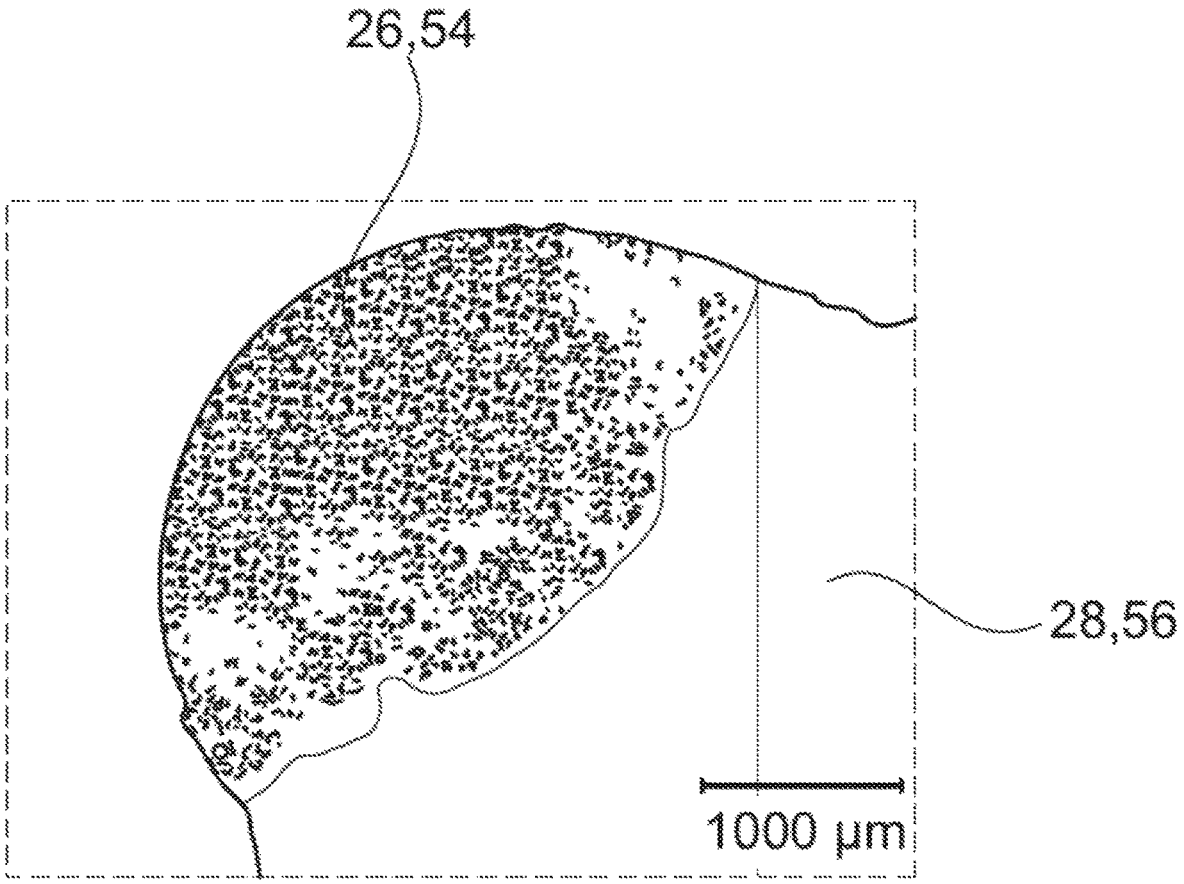
FIG. 4 illustrates a schematized perspective view in a cylinder bore of an engine block.
Figure 5:
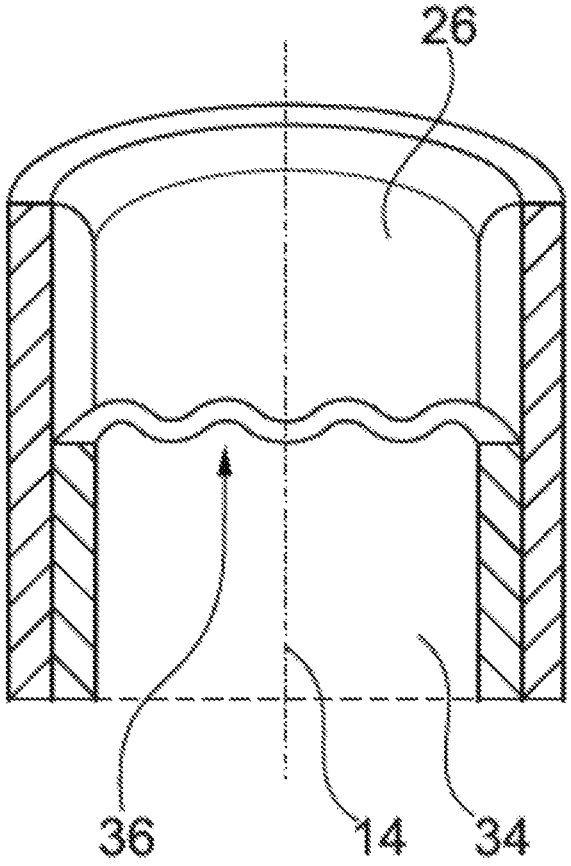
FIG. 5 illustrates a schematized perspective view in a cylinder bore of an alternative embodiment of an engine block.
Figure 6:
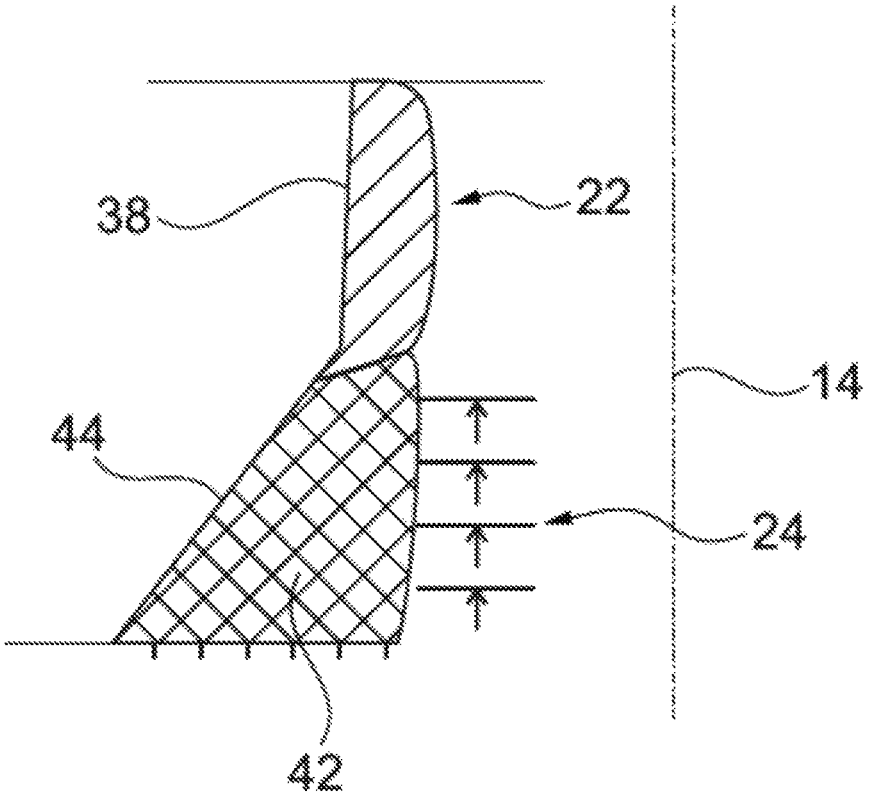
FIG. 6 illustrates a detail of another alternative embodiment of an engine block in a schematic sectioned side view.
Figure 7:
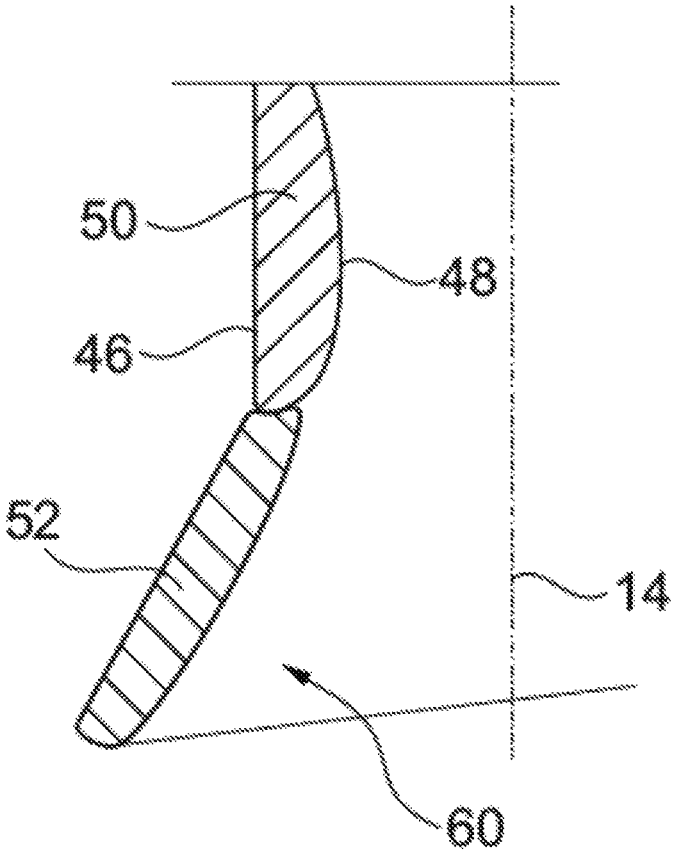
FIG. 7 illustrates a detail of an additional alternative embodiment of an engine block in a schematic sectioned side view.
Figure 8:
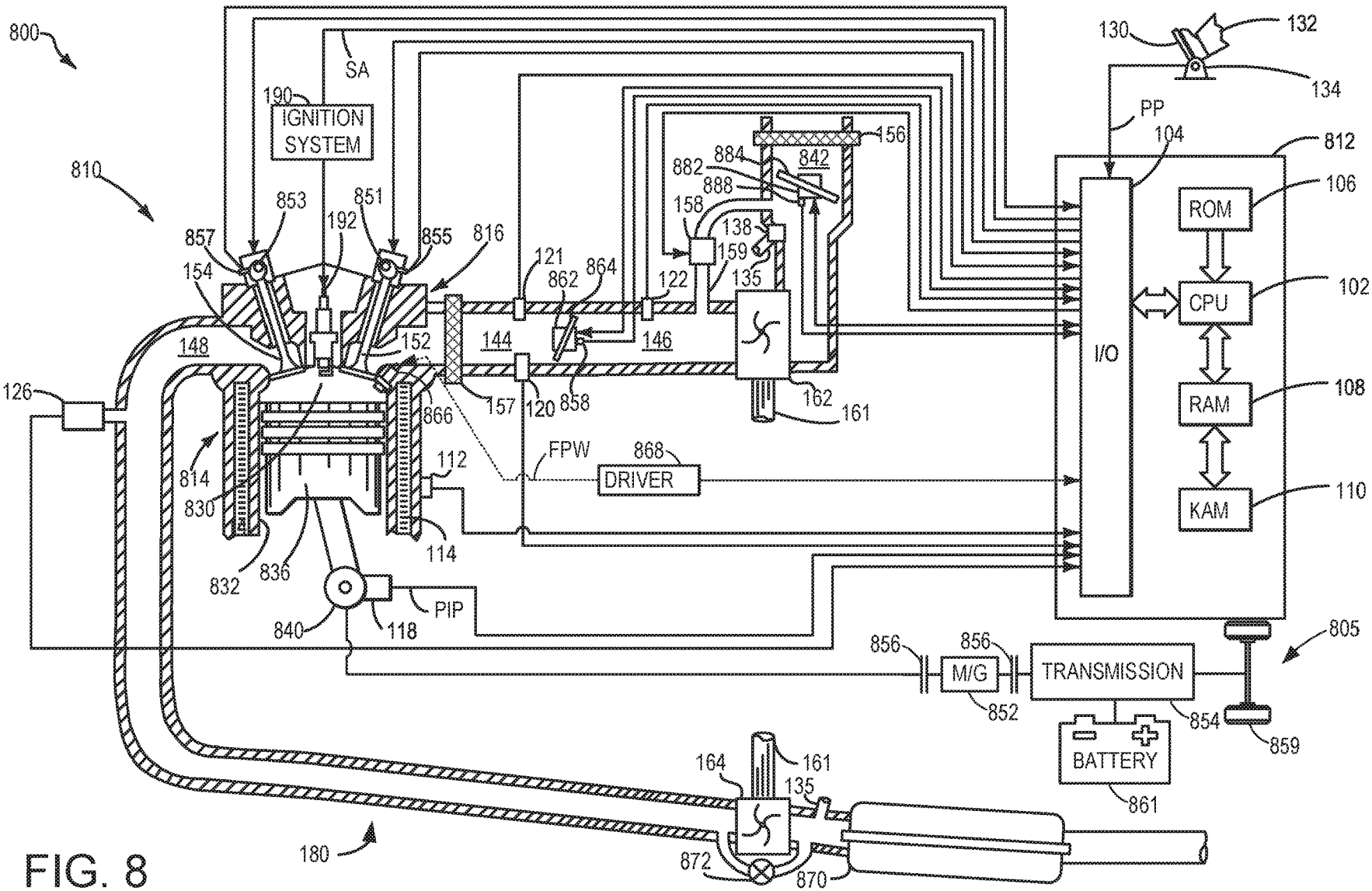
FIG. 8 illustrates a schematic of an engine including at least one cylinder being arranged in a hybrid vehicle system.
Figure 9:
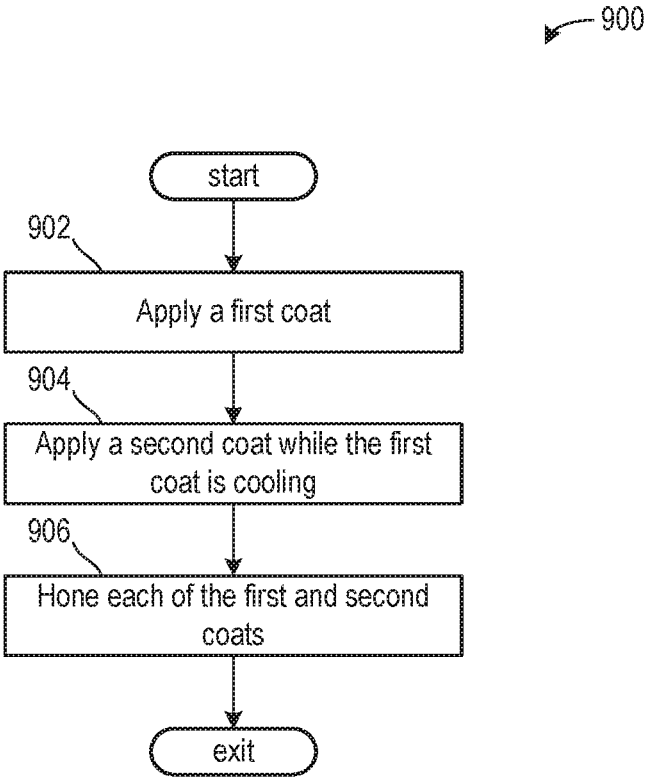
FIG. 9 illustrates a method for applying a first coat and a second coat to a portion of the combustion chamber associated with the cylinder block.
Figure 10:
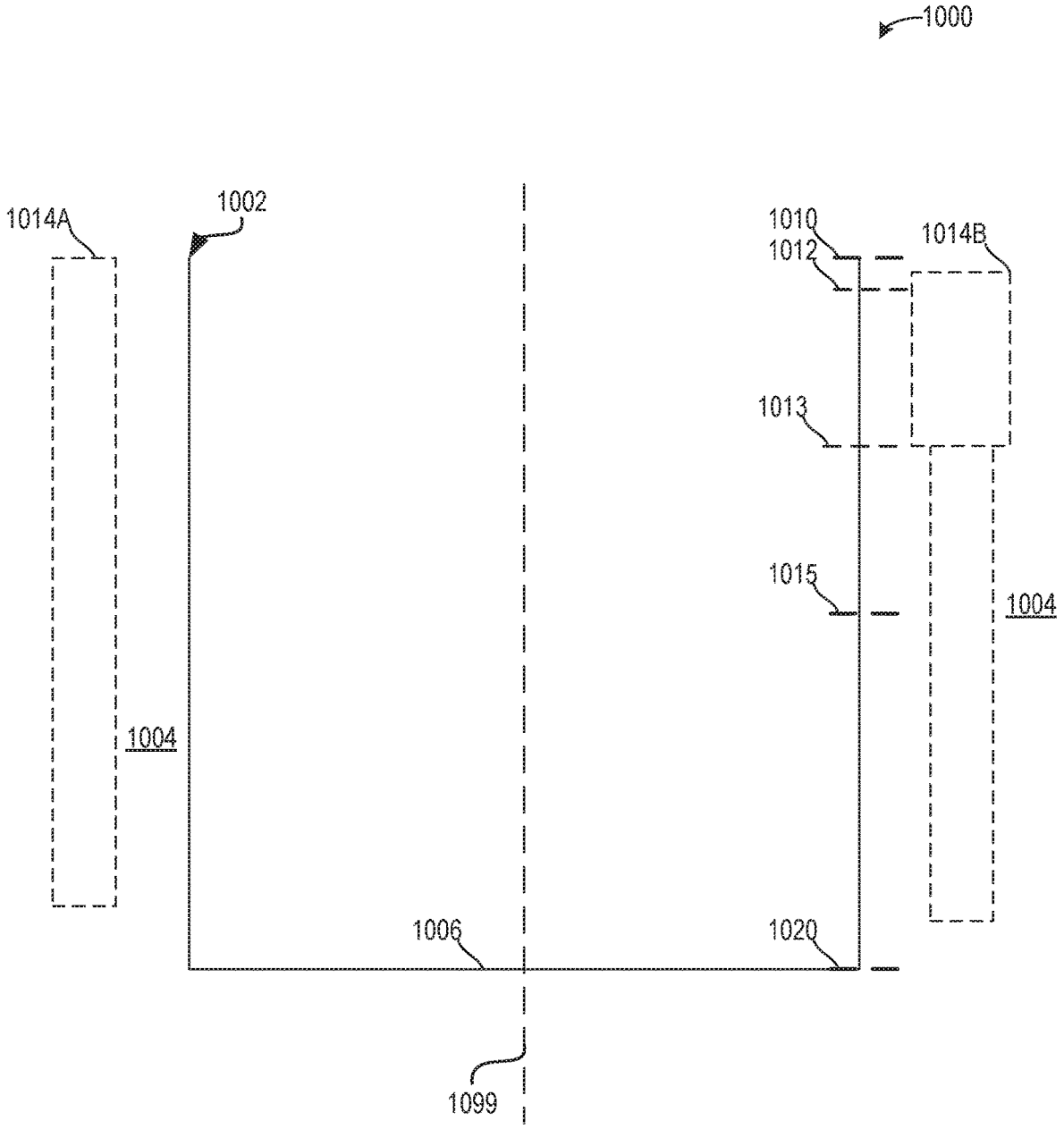
FIG. 10 illustrates an example combustion chamber with a piston positioned to oscillate therein.

The following description relates to systems and methods for an engine block comprising surfaces shaping interior surfaces of a combustion chamber, wherein a first coating and a second coating are arranged on the interior surfaces of the combustion chamber. FIG. 1 illustrates a schematic view of a part of an engine block in a sectioned view. FIG. 2 illustrates a detail of the engine block in a schematic sectioned side view. FIG. 3 illustrates a schematic view of a detail of an alternative embodiment of an engine block. FIG. 4 illustrates a schematized perspective view in a cylinder bore of an engine block. FIG. 5 illustrates a schematized perspective view in a cylinder bore of an alternative embodiment of an engine block. FIG. 6 illustrates a detail of another alternative embodiment of an engine block in a schematic sectioned side view. FIG. 7 illustrates a detail of an additional alternative embodiment of an engine block in a schematic sectioned side view. FIG. 8 illustrates a schematic of an engine including at least one cylinder being arranged in a hybrid vehicle system. FIG. 9 illustrates a method for applying a first coat and a second coat to a portion of the combustion chamber associated with the cylinder block. FIG. 10 illustrates an example combustion chamber with a piston positioned to oscillate therein.

The present disclosure aims to provide an engine block of an internal combustion engine, consisting of aluminum or at least an aluminum alloy, with at least one piston path. Heat flows of waste heat, which may be generated during operation of the internal combustion engine are optimized on account of the thermally conductive properties. More specifically, the engine block thermal properties are enhanced to promote heat retention and heat dissipation in desired areas, where heat retention may be prioritized in lower regions of the engine block distal to a cylinder head, and heat dissipation may be prioritized in upper region of the engine block proximal to the cylinder head.

The engine block according to the present disclosure of an internal combustion engine has at least one cylindrical piston path, with a longitudinal axis, which is enclosed by the engine block in at least an operating state. The piston path serves especially for guiding a piston along the longitudinal axis in an operating state of the engine block. The engine block can be produced especially from aluminum or at least an aluminum alloy. Furthermore, the engine block can be produced in a high-pressure die casting (HPDC) process.

In one embodiment, the piston path, in a section which is close to the top dead center position, has a first internal, extensive coating with higher thermal conductivity than that of the radially adjacent material with regard to the longitudinal axis, wherein the radially adjacent material may correspond to the material of the engine block. Furthermore, the piston path, in a section which is close to the bottom dead center position, has a second internal, extensive coating with lower thermal conductivity than that of the radially adjacent material with regard to the longitudinal axis, wherein the radially adjacent material may correspond to the material of the engine block. In one example, the material of the engine block radially adjacent to the first internal, extensive coating is substantially identical to the material of the engine block radially adjacent to the second internal, extensive coating.

The terms "first", "second", etc. which are used in this application serve only for the purpose of differentiation. In particular, no sequence or priority of the objects which are referred to in relation to these terms is to be implied by their use.

As a result of the proposed coatings of the at least one piston path, an improved dissipation of process heat from an upper region of the piston path into a provided cooling-fluid passage, such as a cooling jacket of a combustion chamber, can be achieved. Therefore, knock can be preempted even in the case of high specific power outputs of the engine block. Also, as a result of the proposed coatings of the at least one piston path, a heat insulation of the lower region of the piston path can be provided. This is desirable in order to mitigate a lowering of the temperature in this region, as a result of which thermal efficiency of the engine block can be improved and losses due to increased viscosity of the lubricant in the lower region of the piston path can be reduced. Both effects advantageously lead to lower fuel consumption and lower emissions.

The upper region near the top dead center position comprises a coating with a higher thermal conductivity than that of the radially adjacent material of the engine block. The lower region near the bottom dead center position comprises a coating with a lower thermal conductivity than that of the radially adjacent material of the engine block. As such, the thermal conductivity of the coating of the upper section is higher than the thermal conductivity of the coating of the lower section, wherein the thermal conductivity of the coating of the upper section is greater than that of an axially adjacent material, which corresponds to the thermal conductivity of the coating of the lower section. Furthermore, it may be desired for the thermal conductivity of the coating of the lower section to be lower than the thermal conductivity of the radially adjacent material of the engine block to mitigate heat from the coating of the upper section flowing into the coating of the lower section. By doing this, heat insulation of the lower section of the piston path may be realized.

The proposed coating of the piston paths of an engine block of an internal combustion engine can be used on engine blocks which are produced from aluminum or at least an aluminum alloy.

The at least one piston path, in an operationally cold state, may comprise a conically shaped widening at least in the section which is close to the bottom dead center position. Due to the higher thermal expansion in the upper section close to the top dead center position, in a transition from the operationally cold state into an operationally hot state, a cylindrical piston path can be achieved in the operationally hot state via a suitably conically shaped widening and friction losses of the piston along the piston path can be reduced so that a dimensionally optimized piston path with low friction losses in combination with a desired heat insulation of the lower section of the piston path can be achieved.

In some embodiments of the engine block, the at least one piston path is formed by an inner wall of a cylinder bore in the engine block or an inner surface of a cylinder liner. When coating the inner wall of the cylinder bore in the engine block, inserting the cylinder liner into the casting mold, for example into a pressure die-casting mold, of the engine block can be avoided when producing the engine block. An advantage in respect to installation space can also be achieved by avoiding a cylinder liner.

If a cylinder liner is used, the inner surface of the cylinder liner can advantageously provide a pore-free surface for accepting the proposed coatings. The cylinder liner may be produced from a high thermally conductive aluminum pressure die-cast alloy, for example A226 (EN AC-Al $Si_9Cu_3$ (Fe), with a thermal conductivity of $$110-120\frac{W}{m\cdot K}),$$

for example.

The first internal coating preferably contains a hypereutectic aluminum-silicon alloy with at least 12% silicon. In this way, in addition to high heat dissipation (thermal conductivity of approximately $$140\frac{W}{m\cdot K}),$$

favorable tribological properties and high wear resistance can also be achieved in the section of the piston path which is close to the top dead center position.

The second internal coating preferably contains an iron-based alloy. By a suitable embodiment of the coating process the iron-based alloy can have a microcrystalline structure with a high number of imperfections, pores and a high proportion of low thermally conductive oxides, as a result of which a low thermal conductivity of the second internal coating can be achieved. In one example, the imperfections of the second internal coating may include one or more surface features including protrusions, grooves, etchings and the like so that a surface of the second internal coating is rough and not smooth. In this way, a metal-based thermal barrier coating with favorable tribological properties can be provided in the lower section which is close to the bottom dead center position.

A portion of the second internal coating may comprise, at least partially, an iron-based nanocomposite material. As a result of the nano-structuring, the second internal coating can comprise good tribological properties and also a relatively low thermal conductivity of approximately $$2\frac{W}{m\cdot K}.$$

In preferred embodiments of the engine block, the first internal coating extends in a region along the longitudinal axis which corresponds to a rotational angle range of the internal combustion engine of between 5° and 50° before and after a top dead center position. Additionally or alternatively, the first internal coating, which is higher in thermal conductivity than the second internal coating, may be arranged in a rotational range between 20° and 40° before and after the top dead center position. By doing this, the first internal coating extends in a region along the longitudinal axis which corresponds to a region of between the upper 25% and 15% of the piston stroke. By coupling the extent of the first internal coating with the ignition point of the engine block, that is to say in the upper region of the piston stroke, it can be ensured that an effective heat dissipation can be provided in a region where high process heat is created. The second internal coating is preferably adjacent to the first internal coating, and is therefore arranged from a bottom dead center position along the longitudinal axis, preferably adjacent to the first internal coating. Thus, if the first internal coating coats an upper 15% of the engine block, then the second internal coating may coat the remaining lower 85% of the engine block. In some examples, additionally or alternatively, the first and second internal coatings may overlap, such that the first internal coating coat the upper 15% and the second internal coating coats a lower 88%, thereby resulting in a 3% overlap between the first and second internal coatings. In this way, the second internal coating may cover a greater surface area of the engine block associated with the combustion chamber than the first internal coating.

Proposed in a further aspect of the disclosure is a method for producing the engine block according to the disclosure. The method may comprise producing the first internal, extensive coating on a rough piston path via a thermal process with an aluminum-silicon alloy with a silicon content of at least 12% as the coating material, producing the second internal, extensive coating on the rough piston path via a thermal process with an iron-based material as the coating material, and skimming the first internal, extensive coating and the second internal, extensive coating to a predetermined intended dimension for the dimensional finishing of the piston path from the rough piston path.

The thermal processes which may be used for producing the coatings, without being limited thereto, can be designed as a thermal spraying process (a laser spraying, rotating single wire (RSW) spraying process, a plasma transferred wire arc (PTWA) spraying process, plasma spraying (atmospheric, protective gas-) wire flame spraying, high velocity oxygen fuel (HVOF) flame spraying or as a deposition welding process (laser deposition welding, laser cladding).

In one example, the first internal, extensive coating is produced via a laser deposition welding process or a rotating single wire (RSW) process.

In one example, the second internal, extensive coating is produced via a rotating single wire (RSW) process.

Consequently, the first internal coating and the second internal coating can be produced in an effective, time saving manner and with good adherence to the rough piston path.

The step of skimming the first internal, extensive coating and the second internal, extensive coating down a predetermined intended dimension is executed via honing. In this way, an internal surface of the piston path, which has favorable lubricant guiding and retaining properties, can be provided.

The iron-based material for coating the second internal, extensive coating is configured as a nanocomposite material.

Preferably, the first internal coating is generated via a laser cladding process, and after that the second internal coating is generated via a thermal spraying process during a cooling down phase of the first coating, as a result of which the process heat of the laser cladding process is additionally used during the production of the second coating in order to increase its adherence strength.

In some embodiments of the method, the first internal, extensive coating generated via a thermal spraying process, and then the second internal, extensive coating is produced via a thermal spraying process. In this case, the first coating and the second coating partially overlap in the direction of the longitudinal axis, and the second coating is deposited on the spray-rough first coating. As a result, a uniform transition between the first coating and the second coating with a high degree of adherence strength on the rough piston path and between the first coating and the second coating can be achieved.

In some embodiments of the method, additionally or alternatively, the second internal, extensive coating is first generated via a thermal spraying process, and then the first internal, extensive coating is generated via a laser cladding welding process. In this way, a weld-metallurgical bond with high mechanical strength can be achieved on the transition between the first internal coating and the second internal coating. Also created, due to the fact that the first internal, extensive coating is bonded in a fusion-metallurgical manner to the radially adjacent material with regard to the longitudinal axis, is a heat dissipation which is significantly improved compared with a coating via a thermal spraying process.

In the case of the last-named embodiments of the method, the first internal coating and the second internal coating are preferably produced in such a way that the first internal coating and the second internal coating partially overlap in the direction of the longitudinal axis. As a result, the adherence strength of the second internal coating can be increased.

A further improvement of the adherence strength of the second internal coating can ensue if the first internal coating, at least in a region of the overlap with the second internal coating, is constructed in a wave-shaped form along a circumference around the longitudinal axis. By avoiding an abrupt transition between the first internal coating and the second internal coating, crack development between the first internal coating and the second internal coating can be effectively avoided.

During a production of the first internal coating, which contains a hypereutectic aluminum-silicon alloy with at least 12% silicon, via a laser cladding process, silicon in powder form may be desired to be introduced in addition, for example injected, into the welding process. As a result, the silicon content of the hypereutectic aluminum-silicon alloy can be further increased, for example to a proportion of between 30% and 40%, as a result of which the thermal conductivity and the wear resistance of the piston path can be further increased.

As a preparatory step, all the steps of the referenced embodiments of the method can be preceded by a roughing of the rough piston path. For example, as a result of the step of roughing, an as known per se dovetail profile can be produced on a surface of the rough piston path, having a number of undercuts via which adherence strength of the coatings can be increased.

FIGS. 1-8 and 10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 1, it shows an exemplary embodiment of an engine block 10 according to the disclosure of an internal combustion engine. The engine block 10 may be produced from an aluminum alloy, for example from A226 (EN AC-Al $Si_9Cu_3$(Fe)), via a pressure die-cast process. The engine block 10 is provided as part of a four-cylinder inline internal combustion engine for use in an automobile and has four cylindrical piston paths, enclosed by the engine block, of which one piston path 20 is shown by way of example in FIG. 1.

The piston path 20 is formed by an inner wall of a cylinder bore in the engine block 10, which defines a rough piston path 18 on which the coatings may be deposited, as is described below. The uncoated piston path may be referred to as a rough piston path 18 for differentiation in the following text. FIG. 1 shows the piston path 20 in a finished state.

Alternatively, the piston path can also be formed by an inner surface of a cylinder liner consisting of an aluminum alloy, wherein the cylinder liner is positioned in the pressure die-casting mold during the production of the engine block.

A center line of the cylindrical piston path 20 defines a longitudinal axis 14 along which a piston (not shown) is guided during operation of the engine block 10. Radial directions 16 are arranged transversely to the longitudinal axis 14 of the piston path 20.

An extensively arranged cooling passage 12, for dissipating process heat which is created during operation of the internal combustion engine, is provided in a known manner per se in the engine block 10 at a distance from the cylinder wall. In one example, the cooling passage 12 is a cylinder cooling jacket arranged in a cylinder side wall.

In a section 22, which is close to the top dead center position, which is shown at the top of the engine block 10 in FIG. 1, the piston path 20 has a first internal, extensive coating 26 with a higher thermal conductivity than that of the radially adjacent material, which is $$110-120\frac{W}{m\cdot K}.$$

The first internal coating 26 contains a hypereutectic aluminum-silicon alloy 54 with a silicon content of approximately 40%, which has a thermal conductivity of $$140\frac{W}{m\cdot K},$$

increased tribological properties, and a high degree of wear resistance.

The first internal coating 26 extends in a region along the longitudinal axis 14 which corresponds to a rotational angle range of the internal combustion engine of between 5° and 50°, before and after a top dead center position. Additionally or alternatively, the first internal coating 26 is arranged in the region along the longitudinal axis 14 corresponding to a rotational angle range of the internal combustion engine of between 20° and 40°, before and after the top dead center position. By doing this, the first internal coating 26 preferably extends in a region along the longitudinal axis which corresponds to a region between the upper 25% and 15% of the piston stroke. In this region, the greatest process heat is created during operation of the internal combustion engine, which process heat, on account of the high thermal conductivity and the high temperature conductivity $$\left(\frac{\lambda}{c\cdot\rho}\right.,$$

with thermal conductivity λ, specific thermal capacity c and density ρ) of the first internal coating 26, is quickly dissipated in the radial direction 16 to the cooling passage 12. Furthermore, by applying the first internal coating 26 to the region where the greatest process heat is created, increased manufacturing costs of the engine block 10 may be avoided.

In a section 24 which is close to the bottom dead center position, which is shown at the bottom in FIG. 1, the piston path 20 has a second internal, extensive coating 28 with a lower thermal conductivity than that of the radially adjacent material. The second internal coating 28 contains an iron-based alloy which is formed as nanocomposite material 56 and has a thermal conductivity of approximately $$2\frac{W}{m\cdot K}.$$

The iron-based alloy which is commercially available as nanocomposite wire (140 MXC, Praxair Surface Technologies) has an iron proportion of between 20% and 50% and in addition to iron contains proportions of chromium, tungsten, niobium, boron, molybdenum, manganese and carbon. As can be seen by way of example in FIG. 1, the second internal coating 28 adjoins the first internal coating 26.

Alternatively, the second internal, extensive coating can contain an iron-based alloy which is formed by an iron-carbon alloy, for example with 0.8% carbon, with a high pore proportion. A second internal, extensive coating which is designed in such way can have a thermal conductivity of approximately $$20\frac{W}{m\cdot K}.$$

Before a deposition of the coatings, a surface of the rough piston path 18 is roughened in a preparatory step. For this, a variety of methods known to those of ordinary skill in the art may be used, wherein the rough piston path 18 may be roughened via etchings, grooves, protrusions, and the like. As a result of using such methods, the surface of the rough piston path 18 can have in a known manner a so-called dovetail profile which provides desired preconditions for a high degree of adherence strength for coatings.

The first internal coating 26 is extensively deposited on the rough piston path 18 via a thermal process which is designed as laser cladding. In this case, an aluminum-silicon alloy, with a proportion of 12% silicon, in powder form is used as cladding material and at the same time silicon is injected in powder form in order to increase the silicon proportion to 40%. Since the rough piston path 18 is melted down over the surface at the cladding point, a weld-metallurgical bond with high mechanical strength is created and described in greater detail with respect to FIG. 4.

The second internal coating 28 is extensively deposited on the rough piston path 18 via a thermal process which is configured as a rotating single wire (RSW) process. In this case, an electric arc, with current intensities of up to 150 A, is ignited between a cathode and the feedable nanocomposite wire with the iron-based alloy as the anode, wherein the nanocomposite wire is melted at the position of the arc. A gas, which is introduced the molten nanocomposite material, is deposited on the rough piston path 18 as coating material. The deposited, second internal coating 28 may have a thermal conductivity of approximately $$2\frac{W}{m\cdot K}.$$

After deposition of the material of the first internal coating 26 and of the material of the second internal coating 28, these materials are partially removed on the inner side from the coated rough piston path 18 for dimensional finishing of the piston path 20. The removal of material is carried out via honing tools in a plurality of honing steps.

In the exemplary embodiment of FIG. 1, the layer thicknesses of the first internal coating 26 and of the second internal coating 28 are approximately 250 μm after dimensional finishing of the piston path 20.

Turning now to FIG. 3, it shows an alternative embodiment of a second internal coating 34 in which a rough piston path 30, in the section 24 which is close to the bottom dead center position, has a parallel offset 32 in relation to the section 22 which is close to the top dead center position. FIG. 3 further shows the coated rough piston path 30 in a state before the dimensional finishing. The parallel offset 32 enables a greater layer thickness of the second internal coating 34 in the radial direction, of 750 μm in this specific embodiment, compared with the first internal coating 26 with a layer thickness of approximately 250 μm, as a result of which the thermal barrier effect of the second internal coating 34 is augmented. Thus, in the example of FIG. 3, the second internal coating 34 may comprise a thickness greater than a thickness of the first internal coating 26. In one example, the second internal coating 34 is twice as thick as the first internal coating 26. In one example, the second internal coating 34 is three times as thick as the first internal coating 26. Additionally or alternatively, the second internal coating 34 may be four or more times as thick as the first internal coating 26.

In a possible embodiment of a method for producing an engine block 10 according to the disclosure according to FIG. 2, the second internal, extensive coating 28 is first produced via a rotating single wire (RSW) process. Next, the first internal, extensive coating 26 is produced via the laser cladding process. Consequently, a weld-metallurgical bond with a weld seam 58 with high mechanical strength is also achieved at the transition between the first internal coating 26 and the second internal coating 28. FIG. 2 shows the coated rough piston path 18 in a state before the dimensional finishing. The weld seam 58 may further correspond to an overlap between the first internal, extensive coating 26 and the second internal, extensive coating 28.

In another possible embodiment of the method, the first internal, extensive coating 26 is first produced via an alternative thermal spraying process which is designed as a wire-electric arc spraying process. After that, the second internal, extensive coating 28 is also produced via a wire-electric arc spraying process, wherein the first internal coating 26 and the second internal coating 28 partially overlap in the direction of the longitudinal axis 14 and the second internal coating 28 is deposited onto the spray-rough first internal coating 26. In this way, a uniform transition between the first internal coating 26 and the second internal coating 28 with a high degree of adherence strength is achieved on the rough piston path 18 and also between the first internal coating 26 and the second internal coating 28.

In a further embodiment shown in FIG. 5, the first internal coating 26 is constructed in a wave-shaped form along a circumference around the longitudinal axis 14 at least in a region of the overlap 36 with the second internal coating 28. As a result, an abrupt transition between the first internal coating 26 and the second internal coating 28 may be avoided and a likelihood of a crack developing between the two coatings 26, 28 is effectively reduced.

Turning now to FIG. 6, it shows a schematic view of a detail of another alternative embodiment of an engine block in the same view as FIG. 2. For reasons of clarity, only the differences to the embodiment shown in FIG. 2 are described.

The rough piston path 38 of the alternative embodiment of an engine block has a conically shaped recess 44 in the section 24 close to the bottom dead center position compared with the section 22 which is close to the top dead center position. FIG. 6 shows the coated rough piston path 38 in a state before the dimensional finishing. After a skimming step has been conducted for the dimensional finishing, the piston path has a constant diameter. The conically shaped recess 44 of the rough piston path enables a radial layer thickness of a second internal coating 42 which linearly increases in the downward direction along the longitudinal axis 14 and which is produced via a stepped offset movement of the RSW device, wherein the stepped offset may include more than five steps, each step representing a radial layer thickness increase of the second internal coating 42. The radial layer thickness of the second internal coating 42, which linearly increases in the downward direction, leads to a downwardly increasing thermal barrier effect along the longitudinal axis 14.

Turning now to FIG. 7, it shows a schematic view of a detail of a further alternative embodiment of an engine block in the same view as FIG. 6. Again, only the differences to the embodiment shown in FIG. 6 are described. In the further alternative embodiment, the rough piston path 46, in an operationally cold state, has a conically shaped widening 60 in the section 24 which is close to the bottom dead center position and can be produced for example by using an as known per se shape honing process on the inner wall of the cylinder bore. A transition between the upper, cylindrical part of the rough piston path 46 and the conically shaped widening 60 can be designed as a convex rounding so that a trumpet-like shape of the rough piston path 46 is created. In alternative embodiments, the conically shaped widening can have a slightly concave or a slightly convex curvature in the direction of the longitudinal axis 14.

In an operationally hot state, the piston path 48 which is formed in this way has an almost perfectly cylindrical shape where friction losses during a movement of the piston along the longitudinal axis 14 of the piston path 46 are reduced. After skimming of the first internal, extensive coating 50 and of the second internal, extensive coating 52 for the dimensional finishing of the piston path 48 via shape honing tools in a plurality of honing steps, the first internal, extensive coating 50 and the second internal, extensive coating 52 have a constant layer thickness perpendicularly to the rough piston path 46. FIG. 7 shows the piston path 48 in a state after the dimensional finishing. The conically shaped widening 60, where a reduction of friction losses during movement of the piston along the longitudinal axis 14 of the piston path 48 can be achieved, remains after production of the first internal coating 50 and of the second internal coating 52 in the operationally cold state. At the same time, this embodiment has the previously stated advantages of heat insulation of the lower section 24 of the piston path.

FIG. 8 depicts an engine system 800 for a vehicle. The vehicle may be an on-road vehicle having drive wheels which contact a road surface. Engine system 800 includes engine 810 which comprises a plurality of cylinders. FIG. 8 describes one such cylinder or combustion chamber in detail. The various components of engine 810 may be controlled by electronic engine controller 812.

Engine 810 includes a cylinder block 814 including at least one cylinder bore, and a cylinder head 816 including intake valves 152 and exhaust valves 154. Engine block 814 may comprise engine block 10 of FIG. 1, in one example. In other examples, the cylinder head 816 may include one or more intake ports and/or exhaust ports in examples where the engine 810 is configured as a two-stroke engine. The cylinder block 814 includes cylinder walls 832 with piston 836 positioned therein and connected to crankshaft 840. The cylinder walls 832 may comprise one or more coatings for adjusting heat transfer from the cylinder walls 832. In one example, a portion of the cylinder walls 832 near the cylinder head 816 comprise a first coating with a first thermal conductivity and a portion of the cylinder walls 832 distal to the cylinder head 816 comprise a second coating with a second thermal conductivity, wherein the first coating increases heat dissipation from the cylinder walls 832 relative a material of the cylinder walls 832, and where the second coating increases heat retention within a volume shaped by the cylinder walls 832 relative to the material of the cylinder walls 832.

Thus, when coupled together, the cylinder head 816 and cylinder block 814 may form one or more combustion chambers. As such, the combustion chamber 830 volume is adjusted based on an oscillation of the piston 836. Combustion chamber 830 may also be referred to herein as cylinder 830. The combustion chamber 830 is shown communicating with intake manifold 144 and exhaust manifold 148 via respective intake valves 152 and exhaust valves 154. Each intake and exhaust valve may be operated by an intake cam 851 and an exhaust cam 853. Alternatively, one or more of the intake and exhaust valves may be operated by an electromechanically controlled valve coil and armature assembly. The position of intake cam 851 may be determined by intake cam sensor 855. The position of exhaust cam 853 may be determined by exhaust cam sensor 857. Thus, when the valves 152 and 154 are closed, the combustion chamber 830 and cylinder bore may be fluidly sealed, such that gases may not enter or leave the combustion chamber 830.

Combustion chamber 830 may be formed by the cylinder walls 832 of cylinder block 814, piston 836, and cylinder head 816. Cylinder block 814 may include the cylinder walls 832, piston 836, crankshaft 840, etc. Cylinder head 816 may include one or more fuel injectors such as fuel injector 866, one or more intake valves 152, and one or more exhaust valves such as exhaust valves 154. The cylinder head 816 may be coupled to the cylinder block 814 via fasteners, such as bolts and/or screws. In particular, when coupled, the cylinder block 814 and cylinder head 816 may be in sealing contact with one another via a gasket, and as such the cylinder block 814 and cylinder head 816 may seal the combustion chamber 830, such that gases may only flow into and/or out of the combustion chamber 830 via intake manifold 144 when intake valves 152 are opened, and/or via exhaust manifold 148 when exhaust valves 154 are opened. In some examples, only one intake valve and one exhaust valve may be included for each combustion chamber 830. However, in other examples, more than one intake valve and/or more than one exhaust valve may be included in each combustion chamber 830 of engine 810.

In some examples, each cylinder of engine 810 may include a spark plug 192 for initiating combustion. Ignition system 190 can provide an ignition spark to cylinder 814 via spark plug 192 in response to spark advance signal SA from controller 812, under select operating modes. However, in some embodiments, spark plug 192 may be omitted, such as where engine 810 may initiate combustion by auto-ignition or by injection of fuel as may be the case with some diesel engines.

Fuel injector 866 may be positioned to inject fuel directly into combustion chamber 830, which is known to those skilled in the art as direct injection. Fuel injector 866 delivers liquid fuel in proportion to the pulse width of signal FPW from controller 812. Fuel is delivered to fuel injector 866 by a fuel system (not shown) including a fuel tank, fuel pump, and fuel rail. Fuel injector 866 is supplied operating current from driver 868 which responds to controller 812. In some examples, the engine 810 may be a gasoline engine, and the fuel tank may include gasoline, which may be injected by injector 866 into the combustion chamber 830. However, in other examples, the engine 810 may be a diesel engine, and the fuel tank may include diesel fuel, which may be injected by injector 866 into the combustion chamber. Further, in such examples where the engine 810 is configured as a diesel engine, the engine 810 may include a glow plug to initiate combustion in the combustion chamber 830.

Intake manifold 144 is shown communicating with throttle 862 which adjusts a position of throttle plate 864 to control airflow to engine cylinder 830. This may include controlling airflow of boosted air from intake boost chamber 146. In some embodiments, throttle 862 may be omitted and airflow to the engine may be controlled via a single air intake system throttle (AIS throttle) 882 coupled to air intake passage 842 and located upstream of the intake boost chamber 146. In yet further examples, AIS throttle 882 may be omitted and airflow to the engine may be controlled with the throttle 862.

In some embodiments, engine 810 is configured to provide exhaust gas recirculation, or EGR. When included, EGR may be provided as high-pressure EGR and/or low-pressure EGR. In examples where the engine 810 includes low-pressure EGR, the low-pressure EGR may be provided via EGR passage 135 and EGR valve 138 to the engine air intake system at a position downstream of air intake system (AIS) throttle 882 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 882. Throttle plate 884 controls pressure at the inlet to compressor 162. The AIS may be electrically controlled and its position may be adjusted based on optional position sensor 888.

Ambient air is drawn into combustion chamber 830 via intake passage 842, which includes air filter 156. Thus, air first enters the intake passage 842 through air filter 156. Compressor 162 then draws air from air intake passage 842 to supply boost chamber 146 with compressed air via a compressor outlet tube (not shown in FIG. 1). In some examples, air intake passage 842 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 872 allows exhaust gases to bypass turbine 164 so that boost pressure can be controlled under varying operating conditions. Wastegate 872 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 872 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 840. Thus, the compressor 162 may be coupled to the crankshaft 840 via a mechanical linkage such as a belt. As such, a portion of the rotational energy output by the crankshaft 840, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 8, the charge air cooler 157 may be positioned downstream of the electronic throttle 862 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 870. Alternatively, a two-state exhaust gas oxygen sensor may be substituted for UEGO sensor 126. Emission control device 870 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 870. Additionally or alternatively, the emission control device 870 may comprise a diesel oxidation catalyst (DOC) and/or a diesel cold-start catalyst, a particulate filter, a three-way catalyst, a $NO_x$ trap, selective catalytic reduction device, and combinations thereof.

Controller 812 is shown in FIG. 8 as a microcomputer including: microprocessor unit 102, input/output ports 104, read-only memory 106, random access memory 108, keep alive memory 110, and a conventional data bus. Controller 812 is shown receiving various signals from sensors coupled to engine 810, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 840 position; a measurement of air mass entering the engine from sensor 120 (e.g., a hot wire air flow meter); and a measurement of throttle position from sensor 858. Barometric pressure may also be sensed (sensor not shown) for processing by controller 812. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 805 may be a hybrid vehicle with multiple sources of torque available to one or more vehicle wheels 859. In other examples, vehicle 805 is a conventional vehicle with only an engine, or an electric vehicle with only electric machine(s). In the example shown, vehicle 805 includes engine 810 and an electric machine 852. Electric machine 852 may be a motor or a motor/generator. Crankshaft 840 of engine 810 and electric machine 852 are connected via a transmission 854 to vehicle wheels 859 when one or more clutches 856 are engaged. In the depicted example, a first clutch 856 is provided between crankshaft 840 and electric machine 852, and a second clutch 856 is provided between electric machine 852 and transmission 854. Controller 812 may send a signal to an actuator of each clutch 856 to engage or disengage the clutch, so as to connect or disconnect crankshaft 840 from electric machine 852 and the components connected thereto, and/or connect or disconnect electric machine 852 from transmission 854 and the components connected thereto. Transmission 854 may be a gearbox, a planetary gear system, or another type of transmission. The powertrain may be configured in various manners including as a parallel, a series, or a series-parallel hybrid vehicle.

Electric machine 852 receives electrical power from a traction battery 861 to provide torque to vehicle wheels 859. Electric machine 852 may also be operated as a generator to provide electrical power to charge battery 861, for example during a braking operation.

Turning now to FIG. 9, it shows a method 900 for coating interior surfaces of a combustion chamber. More specifically, the method 900 describes coating interior surfaces of the combustion chamber within an engine block for portions of the combustion chamber adjacent to an oscillation of a piston arranged therein.

The method 900 begins at 902, which includes applying a first coat to an interior surface of the combustion chamber. The first coat may be a higher thermally conductive coat In one example, the first coat applied is substantially identical to the first internal, extensive coat 26 of FIG. 1. As such, the first coat applied may be applied to an upper region of the interior surface of the combustion chamber, wherein the upper region is adjacent to a top-dead center (TDC) position of the piston. In one example, the upper region is within 5% to 50% of the TDC position within the engine block. Additionally or alternatively, the upper region is within 5% to 40% of the TDC position within the engine block. Additionally or alternatively, the upper region is within 10% to 40% of the TDC position within the engine block. Additionally or alternatively, the upper region is within 15% to 40% of the TDC position within the engine block. Additionally or alternatively, the upper region is within 20% to 40% of the TDC position within the engine block. In one example, an amount of the combustion chamber onto which the first coat is applied may be substantially equal to 15% to 25% of a total range of motion of the piston. In this way, the first coat applied may not be applied to a top most portion of the engine block. The first coat may be applied via one or more of a laser cladding and a thermal spray. In some examples, additionally or alternatively, silicon in a powder form may be injected during the application of the first coat to the engine block, wherein the silicon powder is doped into the first coat such that an amount of silicon in the first coat may exceed 20%. In some examples, the amount of silicon increases to 25 to 50%. In some examples, the amount of silicon increases to 30 to 40%.

The method 900 proceeds to 904, which includes applying a second coat while the first coat applied is cooling. The second coat applied may be applied to a remaining uncovered portion of the combustion chamber along which the piston oscillates. For example, if the first coat applied was applied to a portion of the combustion chamber surface corresponding to 20% of a total range of motion of the piston, then the second coat applied may be applied to at least 80% of the total range of motion of the piston. Additionally or alternatively, the first coat applied and the second coat applied may overlap such that a sum of the portions of the combustion chambers the first and second coats applied covers is greater than 100%. In one example, the sum may be between 101 to 110%. Additionally or alternatively, the sum may be between 103% to 107%. The second coat applied may be applied via a thermal spray The method 900 proceeds to 906, which includes honing each of the first and second coats applied. The first and second coats applied may be honed similarly so that their thicknesses are substantially equal. Additionally or alternatively, the first and second coats applied may be honed differently so that their thicknesses are unequal. In one example, the second coat applied is honed so that its thickness is greater than the thickness of the first coat applied. Additionally or alternatively, the second coat applied may be honed to comprise a conical shape, wherein the conical shape may narrow relative to a longitudinal axis along with the piston oscillates or broaden relative to the longitudinal axis.

Additionally or alternatively, in some embodiments of the method 900, the first coat applied may be substantially identical to the second coat 28 of FIG. 1. The second coat may be applied via a thermal spray to the lower region of the combustion chamber. Following application of the first coat applied (e.g., the second coat), a second coat may be applied, wherein the second coat applied is identical to the first coat 26 of FIG. 1. The second coat applied (e.g., the first coat) may be applied via a thermal spray or a laser cladding welding. In some examples, if the second coat applied is applied via the laser cladding welding, then the second coat applied may be applied in the upper region and over adjacent portions of the first coat applied, which may result in a weld-metallurgical bond between the two coats.

Turning now to FIG. 10, it shows an embodiment 1000 of a portion of a combustion chamber 1002 shaped via surfaces of an engine block 1004. The combustion chamber 1002 and the engine block 1004 may be used similarly to combustion chamber 830 and engine block 814 of FIG. 8, respectively. More specifically, the engine block 1004 may form side walls (e.g., cylinder walls 832 of FIG. 8) of the combustion chamber 1002, upon which one or more coatings may be applied to adjust thermal characteristics of the combustion chamber 1002. The combustion chamber 1002 volume may be further defined via a top surface of a piston 1006 and a cylinder head (not shown).

Dashed line markings 1010, 1015, and 1020 illustrate various rotational angle values of a rotational angle range of the piston 1006. A first dashed line marking 1010 may represent a 0° rotational angle value of the piston 1006, wherein the first dashed line marking 1010 further corresponds to a top-dead center position of the piston 1006. A second dashed line marking 1020 may represent a 180° rotational angle value of the piston 1006, wherein the second dashed line marking 1020 further corresponds to a bottom-dead center position of the piston 1006. As such, in the example of FIG. 10, the piston 1006 is in the bottom-dead center position. A third dashed line marking 1015 illustrates a half-way point between the first dashed line marking 1010 and the second dashed line marking 1020, wherein the third dashed line marking 1015 may be equal to a 90° rotational angle value of the piston. As such, the piston 1006, may oscillate about a longitudinal axis 1099 from the first dashed marking 1010 to the second dashed marking 1020 and all positions therebetween.

A first coating (e.g., first coating 26 of FIG. 1) may be applied from the first dashed line marking 1010 at least a lower threshold 1012. The lower threshold 1012 may be equal to a 5° rotational angle value of the piston 1006. Additionally or alternatively, the first coating may be applied from the first dashed line marking 1010 to an upper threshold 1013. The upper threshold 1013 may be equal to a 50° rotational angle value of the piston 1006. Additionally or alternatively, the first coating may be applied from the first dashed line 1010 to a position between the lower threshold 1012 and the upper threshold 1013. Furthermore, the first coating may be continuously applied around a circumference of interior surface of the combustion chamber 1002, so that the first coating is in contact with coolant chambers 1014A and 1014B arranged on both sides of the combustion chamber 1002.

As shown, coolant chamber 1014B comprises a shape different than a shape of coolant chamber 1014A. In one example, coolant chamber 1014B comprises an increased width in the vicinity of the first coating neat top-dead center. By doing this, an increased amount of heat dissipation from the upper region of the combustion chamber 1002 may be captured by the coolant in the portion of the coolant chamber 1014B with the increased width to decrease cold-start times. As such, the portion of the coolant chamber 1014B with the increased width may extend from the first dashed marking 1010 to the upper threshold 1013.

A second coat (e.g., second coat 28 of FIG. 1) may extend from an axial position adjacent to the first coat to the second dashed marking 1020. In this way, the second coat may be applied to a remainder of the interior surfaces of the combustion chamber 1002. In one example, the axial position adjacent to the first coat may be a position where the second coat touches, but does not overlap the first coat. Additionally or alternatively, there may be some overlap between the first coat and the second coat such that the second coat is applied over at least a lower portion of the first coat. In some examples, the first coat may extend over the second coat, wherein a thickness of the first coat is gradually reduced in a longitudinal direction toward a bottom of the cylinder parallel to the longitudinal axis 1099, such that after some distance in the longitudinal direction the first coat thickness is zero and only the second coat is arranged thereafter. In other examples, the second coat may extend over the first coat, a thickness of the second coat being gradually reduced in a longitudinal direction toward a top of the cylinder. In some examples, additionally or alternatively, the second coat and/or the first coat may comprise an angled cut, wherein the angled cut may be arranged at a location where the first coat and the second coat touch. In one example, the angled cut of the first coat and the second coat may be complementary such that a transition from the first coat to the second coat is smooth with a gradual gradient.

In this way, a portion of a combustion chamber shaped via an engine block may comprise one or more coatings for enhancing thermal conductivity of different portions of the combustion chamber. A portion of the combustion chamber near a top-dead center position of a piston arranged to oscillate therein may comprise a first coating with an increased thermal conductivity relative to a thermal conductivity of interior surfaces of the combustion chamber. A portion of the combustion chamber near a bottom-dead center position of the piston may comprise a second coating with a decreased thermal conductivity relative to the thermal conductivity of the interior surfaces of the combustion chamber. The technical effect of applying the first coat and the second coat to the combustion chamber is to increase heat transfer in an upper region of the combustion chamber where high amounts of heat are produced and to decrease heat transfer in a lower region of the combustion chamber to maintain lubricant viscosity and a desired engine operating temperature.

In another representation, an embodiment of an engine block of an internal combustion engine, consisting of aluminum or at least an aluminum alloy, comprises at least one cylindrical piston path, with a longitudinal axis, which is enclosed by the engine block in at least an operating state, wherein the piston path, in a section which is close to the top dead center position, has a first internal, extensive coating with a higher thermal conductivity than that of the radially adjacent material, and in a section which is close to the bottom dead center position, has a second internal, extensive coating with a lower thermal conductivity than that of the radially adjacent material.

A first embodiment of the engine block optionally including the embodiment above, further includes where the at least one piston path, in an operationally cold state, has a conical widening, at least in the section which is close to the bottom dead center position.

A second embodiment of the engine block, optionally including any of the embodiments above, further includes where the at least one piston path is formed by an inner wall of a cylinder bore in the engine block or by an inner surface of a cylinder liner.

A third embodiment of the engine block, optionally including any of the embodiments above, further includes where the first internal coating contains a hypereutectic aluminum-silicon alloy with at least 12% silicon.

A fourth embodiment of the engine block, optionally including any of the embodiments above, further includes where the second internal coating contains an iron-based alloy.

A fifth embodiment of the engine block, optionally including any of the embodiments above, further includes where the second internal coating is formed at least partially as an iron-based nanocomposite material.

A sixth embodiment of the engine block, optionally including any of the embodiments above, further includes where the first internal coating extends in a region along the longitudinal axis which corresponds to a rotational angle range of the internal combustion engine of between 5° and 50°, preferably of between 20° and 40°, before and after a top dead center position, wherein the first internal coating therefore extends in a region along the longitudinal axis which corresponds to a region between the upper 25% and 15% the piston stroke.

An embodiment of a method for producing the engine block of any of the above embodiments, comprises producing a first internal, extensive coating on a rough piston path via a thermal process with an aluminum-silicon alloy with a silicon content of at least 12% as coating material, producing a second internal, extensive coating on the rough piston path via a thermal process with an iron-based material as coating material, and skimming the first internal, extensive coating and the second internal, extensive coating for the dimensional finishing of the piston path from the rough piston path.

A first embodiment of the method optionally including the embodiment above further includes where the first internal, extensive coating is first of all produced via a thermal spraying process and then the second internal, extensive coating is produced via a thermal spraying process, wherein the first internal coating and the second internal coating partially overlap in the direction of the longitudinal axis and the second internal coating is deposited onto the spray-rough first internal coating.

A second embodiment of the method, optionally including any of the embodiments above, further includes where the second internal, extensive coating is first of all produced via a thermal spraying process and then the first internal, extensive coating is produced via a laser cladding process.

A third embodiment of the method, optionally including any of the embodiments above, further includes where the first internal coating and the second internal coating are produced in such a way that the first internal coating and the second internal coating partially overlap in the direction of the longitudinal axis.

A fourth embodiment of the method, optionally including any of the embodiments above, further includes where the first internal coating is constructed in a wave-shaped form along a circumference around the longitudinal axis at least in a region of the overlap with the second internal coating.

An embodiment of an engine block comprises a first coating arranged on interior surfaces of a cylinder near a top-dead center position of a piston and a second coating arranged on the interior surfaces near a bottom-dead center position of the piston, the first coating comprising a hypereutectic aluminum-silicon alloy and the second coating comprising an iron-based alloy with a thermal conductivity lower than the first coating and the interior surfaces. A first example of the engine block, optionally comprising where the interior surfaces comprise aluminum or an aluminum alloy, and where an interior surfaces thermal conductivity is $$110-120\left(\frac{w}{mk}\right),$$

a first coating thermal conductivity is $$140\left(\frac{w}{mk}\right),$$

and a second coating thermal conductivity is $$2\left(\frac{w}{mk}\right).$$

A second example of the engine block, optionally comprising the first example, further comprises where a silicon content of the first coating is greater than 10%. A third example of the engine block, optionally comprising the first and/or second examples, further comprises where the second coating comprises a portion with an iron-carbon alloy comprising between 0.5 to 2% carbon, and where an iron-carbon alloy thermal conductivity is $$20\left(\frac{w}{mk}\right).$$

A fourth example of the engine block, optionally comprising one or more of the first through third examples, further comprises where the second coating comprises between 20 to 50% iron, and where the iron-based alloy further comprises one or more of chromium, tungsten, niobium, boron, molybdenum, manganese, and carbon. A fifth example of the engine block, optionally comprising one or more of the first through fourth examples, further comprises where the first coating is arranged on the interior surfaces of the cylinder at the top-dead center position and extends up to an upper threshold position equal to a 50° rotational angle value of the piston. A sixth example of the engine block, optionally comprising one or more of the first through fifth examples, further comprises where second coating is arranged on the interior surfaces of the cylinder at the bottom-dead center position and extends to at least an extreme end of the first coating. A seventh example of the engine block, optionally comprising one or more of the first through sixth examples, further comprises where the second coating overlaps with the first coating, and where the extreme end of the first coating comprises a wave-like shape. An eighth example of the engine block, optionally comprising one or more of the first through seventh examples, further comprises where the second coating comprises a conically shaped widening, wherein the conically shaped widening widens in a direction toward the bottom-dead center position. A ninth example of the engine block, optionally comprising one or more of the first through eighth examples, further comprises where the first coating is arranged on the interior surfaces via a laser cladding, and where silicon powder is injected during the laser cladding, and where the first coating comprises between 30 to 40% silicon.

An embodiment of a system comprises a combustion chamber shaped between surfaces of an engine head, an engine block, and a piston, the piston shaped to oscillate along a longitudinal axis passing through its center, a first coating arranged on surfaces of the engine block corresponding to interior surfaces of the combustion chamber adjacent to the engine head and a top-dead center position of the piston, and where a first coating thermal conductivity is higher than an interior surfaces thermal conductivity, and where the first coating is an aluminum-silicon alloy comprising greater than 12% silicon, and a second coating arranged on surfaces of the engine block corresponding to interior surfaces of the combustion chamber distal to the engine head and adjacent to a bottom-dead center position of the piston, and where a second coating thermal conductivity is lower than the interior surfaces thermal conductivity, and where the second coating is an iron-alloy with a nanocomposite material. A first example of the system further includes where the first coating comprises a wave-shape at an extreme end where it touches the second coating, and where the second coating overlaps with the first coating and completely covers the wave-shape. A second example of the system, optionally including the first example, further includes where the first coating is arranged on the interior surfaces of the combustion chamber via a laser cladding, and where the second coating is arranged on the interior surfaces of the combustion chamber via a thermal spray after the first coating. A third example of the system, optionally including the first and/or second examples, further includes where the second coating is arranged on the interior surfaces of the combustion chamber via a thermal spray, and where the first coating is arranged on interior surfaces of the combustion chamber via a laser cladding after the second coating, and where a weld-metallurgical bond is arranged between overlapping portions of the first coating and the second coating. A fourth example of the system, optionally including one or more of the first through third examples, further includes where the first coating is arranged from the top-dead center position to an area between a lower threshold and an upper threshold, wherein the lower threshold is equal to a 5° rotational angle value of the piston, and where the upper threshold is equal to a 50° rotational angle value of the piston, and where the second coating extends from an extreme end of the first coating to the bottom-dead center position, and where the second coating touches the extreme end of the first coating.

An embodiment of a method comprises applying a first coating with a first thermal conductivity to interior surfaces of an upper region of a combustion chamber, wherein the first coating is an aluminum-silicon alloy comprising greater than or equal to 12% silicon and applying a second coating with a second thermal conductivity less than the first thermal conductivity to interior surfaces of a lower region of the combustion chamber during a cooling process of the first coating to generate a weld-metallurgical bond therebetween, wherein the upper region extends from a top of a portion of the combustion chamber shaped in an engine block down to a portion of the combustion chamber equal to between 20 to 40% of its total length, and where the lower region extends from the upper region to a bottom of a portion of the combustion chamber shaped in the engine block. A first example of the method further includes where applying the first coating comprises laser cladding welding the first coating. A second example of the method, optionally including the first example, further includes where injecting silicon powder during the applying of the first coating to increase a silicon content of the first coating to between 30 to 40%. A third example of the method, optionally including the first and/or second examples, further includes where honing the first and second coatings to a desired thickness, and where a first coating desired thickness is less than or equal to 250 μm and where a second coating desired thickness is less than or equal to 750 μm. A fourth example of the method, optionally including one or more of the first through third examples, further includes where the second coating comprising a conically shaped widening increasing in width from the upper region to the bottom, and where the second coating comprises an iron-alloy with a microcrystalline structure and where the first coating comprising an aluminum-silicon alloy.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine block comprising:

a first coating arranged on interior surfaces of a cylinder near a top-dead center position of a piston and a second coating arranged on the interior surfaces near a bottom-dead center position of the piston, the first coating comprising a hypereutectic aluminum-silicon alloy and the second coating comprising an iron-based alloy with a thermal conductivity lower than a thermal conductivity of the first coating and a thermal conductivity of the interior surfaces.

2. The engine block of claim 1, wherein the interior surfaces comprise aluminum or an aluminum alloy, and where the thermal conductivity of the interior surfaces is less than the thermal conductivity of the first coating is and greater than the thermal conductivity of the second coating.

3. The engine block of claim 1, wherein a silicon content of the first coating is greater than 10%.

4. The engine block of claim 1, wherein the second coating comprises a portion with an iron-carbon alloy comprising between 0.5 to 2% carbon.

5. The engine block of claim 1, wherein the second coating comprises between 20 to 50% iron, and where the iron-based alloy further comprises one or more of chromium, tungsten, niobium, boron, molybdenum, manganese, and carbon.

6. The engine block of claim 1, wherein the first coating is arranged on the interior surfaces of the cylinder at the top-dead center position and extends up to an upper threshold position equal to a 50° rotational angle value of the piston.

7. The engine block of claim 6, wherein the second coating is arranged on the interior surfaces of the cylinder at the bottom-dead center position and extends to at least an extreme end of the first coating.

8. The engine block of claim 1, wherein the second coating overlaps with the first coating, and where the extreme end of the first coating comprises a wave-like shape.

9. The engine block of claim 1, wherein the second coating comprises a conically shaped widening, wherein the conically shaped widening widens in a direction toward the bottom-dead center position.

10. The engine block of claim 1, wherein the first coating is arranged on the interior surfaces via a laser cladding, and where silicon powder is injected during the laser cladding, and where the first coating comprises between 30 to 40% silicon.

11. A system comprising:

a combustion chamber shaped between surfaces of an engine head, an engine block, and a piston, the piston shaped to oscillate along a longitudinal axis passing through its center;

a first coating arranged on surfaces of the engine block corresponding to interior surfaces of the combustion chamber adjacent to the engine head and a top-dead center position of the piston, and where a first coating thermal conductivity is higher than an interior surfaces thermal conductivity, and where the first coating is an aluminum-silicon alloy comprising greater than 12% silicon; and a second coating arranged on surfaces of the engine block corresponding to interior surfaces of the combustion chamber distal to the engine head and adjacent to a bottom-dead center position of the piston, and where a second coating thermal conductivity is lower than the interior surfaces thermal conductivity, and where the second coating is an iron-alloy with a nanocomposite material.

12. The system of claim 11, wherein the first coating comprises a wave-shape at an extreme end where it touches the second coating, and where the second coating overlaps with the first coating and completely covers the wave-shape.

13. The system of claim 11, wherein the first coating is arranged on the interior surfaces of the combustion chamber via a laser cladding, and where the second coating is arranged on the interior surfaces of the combustion chamber via a thermal spray after the first coating.

14. The system of claim 11, wherein the second coating is arranged on the interior surfaces of the combustion chamber via a thermal spray, and where the first coating is arranged on interior surfaces of the combustion chamber via a laser cladding after the second coating, and where a weld-metallurgical bond is arranged between overlapping portions of the first coating and the second coating.

15. The system of claim 11, wherein the first coating is arranged from the top-dead center position to an area between a lower threshold and an upper threshold, wherein the lower threshold is equal to a 5° rotational angle value of the piston, and where the upper threshold is equal to a 50° rotational angle value of the piston, and where the second coating extends from an extreme end of the first coating to the bottom-dead center position, and where the second coating touches the extreme end of the first coating.

16. A method comprising:

applying a first coating with a first thermal conductivity to interior surfaces of an upper region of a combustion chamber, wherein the first coating is an aluminum-silicon alloy comprising greater than or equal to 12% silicon; and applying a second coating with a second thermal conductivity less than the first thermal conductivity to interior surfaces of a lower region of the combustion chamber during a cooling process of the first coating to generate a weld-metallurgical bond therebetween; wherein the upper region extends from a top of a portion of the combustion chamber shaped in an engine block down to a portion of the combustion chamber equal to between 20 to 40% of its total length, and where the lower region extends from the upper region to a bottom of a portion of the combustion chamber shaped in the engine block.

17. The method of claim 16, wherein applying the first coating comprises laser cladding welding the first coating.

18. The method of claim 17, further comprising injecting silicon powder during the applying of the first coating to increase a silicon content of the first coating to between 30 to 40%.

19. The method of claim 16, further comprising honing the first and second coatings to a desired thickness, and where a first coating desired thickness is less than or equal to 250 μm and where a second coating desired thickness is less than or equal to 750 μm.

20. The method of claim 19, wherein the second coating comprising a conically shaped widening increasing in width from the upper region to the bottom, and where the second coating comprises an iron-alloy with a microcrystalline structure and where the first coating comprising an aluminum-silicon alloy.

* * * * *